US008870248B2

(12) United States Patent
Graute

(10) Patent No.: US 8,870,248 B2
(45) Date of Patent: Oct. 28, 2014

(54) VEHICLE DOOR LATCH

(71) Applicant: Kiekert Aktiengesellschaft, Heiligenhaus (DE)

(72) Inventor: Ludger Graute, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 46 days.

(21) Appl. No.: 13/888,722

(22) Filed: May 7, 2013

(65) Prior Publication Data

US 2013/0241214 A1 Sep. 19, 2013

Related U.S. Application Data

(62) Division of application No. 10/555,300, filed as application No. PCT/DE2004/000919 on Apr. 30, 2004, now Pat. No. 8,434,796.

(30) Foreign Application Priority Data

May 8, 2003 (DE) ..... 103 20 448

(51) Int. Cl.

| | |
|---|---|
| ***E05C 3/06*** | (2006.01) |
| ***E05B 83/36*** | (2014.01) |
| ***E05B 77/28*** | (2014.01) |
| ***E05B 77/30*** | (2014.01) |
| *E05C 3/16* | (2006.01) |
| *E05B 77/26* | (2014.01) |

(52) U.S. Cl.

CPC ..... *E05B 83/36* (2013.01); *E05B 77/28* (2013.01); *E05B 77/30* (2013.01); *E05B 77/26* (2013.01); *Y10S 292/23* (2013.01)

USPC ..... 292/216; 292/DIG. 23; 292/201

(58) Field of Classification Search

USPC ..... 292/216

See application file for complete search history.

(56) References Cited

U.S. PATENT DOCUMENTS

| | | | | |
|---|---|---|---|---|
| 3,290,078 | A * | 12/1966 | Roethel | 292/53 |
| 3,587,259 | A * | 6/1971 | Sandor | 70/218 |
| 5,921,595 | A * | 7/1999 | Brackmann et al. | 292/216 |
| 6,158,788 | A | 12/2000 | Ikeda et al. | |
| 2002/0017792 | A1 * | 2/2002 | Raffelsiefer et al. | 292/216 |
| 2002/0050720 | A1 * | 5/2002 | Helmer | 292/216 |

FOREIGN PATENT DOCUMENTS

| | | |
|---|---|---|
| DE | 100 38 151 A1 | 2/2002 |
| EP | 1 004 730 A1 | 5/2000 |

* cited by examiner

*Primary Examiner* — Mark Williams

(74) *Attorney, Agent, or Firm* — Renner, Otto, Boisselle & Sklar, LLP

(57) ABSTRACT

The object of the present invention is a vehicle door latch with a locking mechanism (1, 2), comprising also at least one operating lever (3*a*, 3*b*) and a locking lever (4, 5). According to the invention, the operating lever (3*a*, 3*b*) contains a first partial lever (3*a*) and a second partial lever (3*b*). The locking lever (4, 5) controls a coupling element (12), optionally connecting the partial levers (3*a*, 3*b*) with each other.

11 Claims, 4 Drawing Sheets

Figure 1:
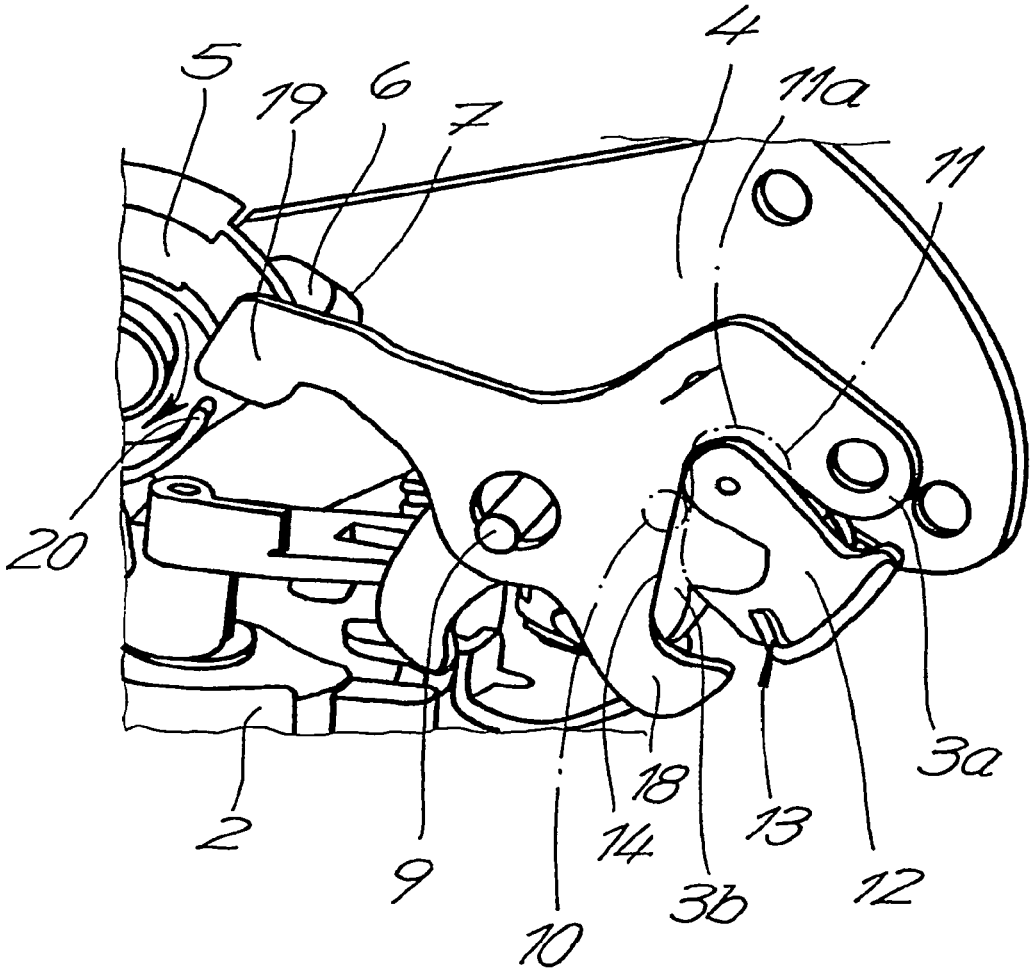

Fig. 4
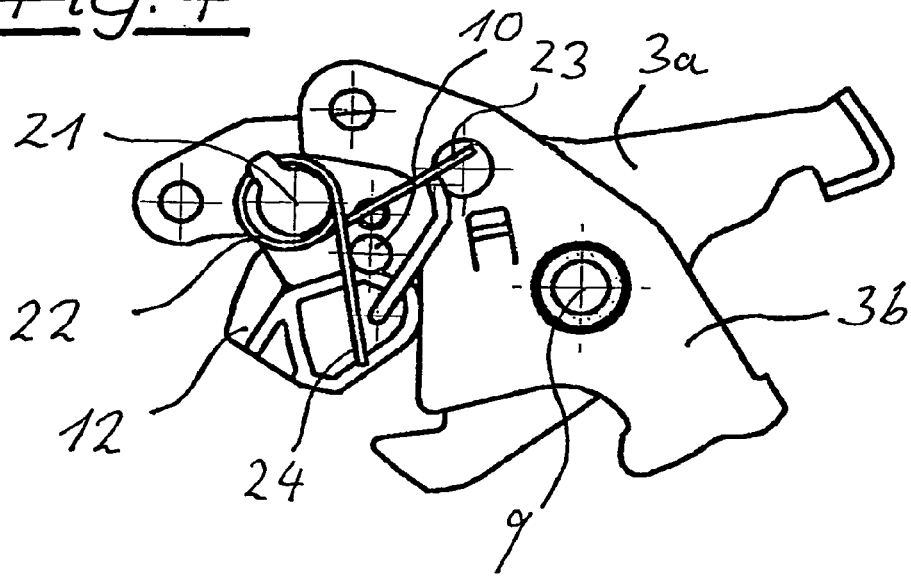
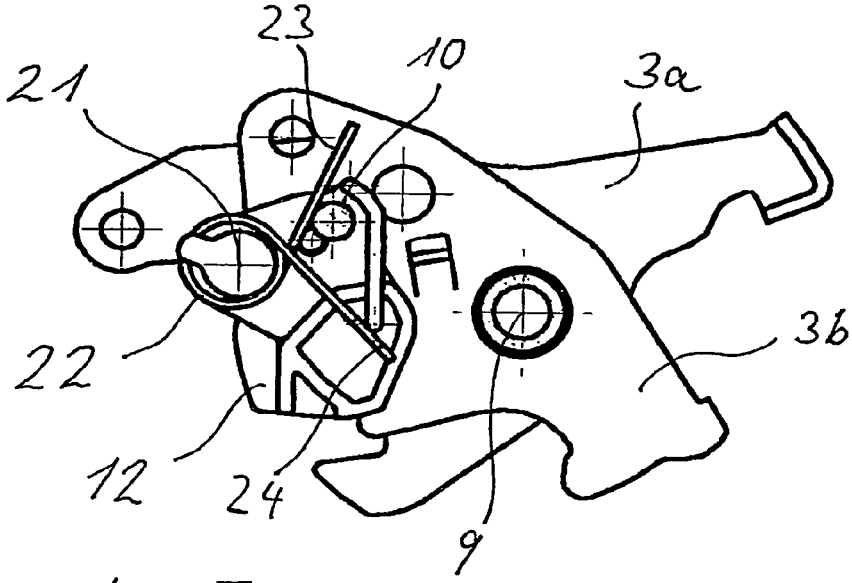
Fig. 5

VEHICLE DOOR LATCH

This is a divisional of U.S. application Ser. No. 10/555,300, filed Nov. 2, 2005, which is a National Phase Application of PCT/DE2004/00919 filed Apr. 30, 2004, all of which are hereby incorporated by reference.

The invention refers to a vehicle door latch with a locking mechanism, comprising also at least an operating lever and a locking lever.

In a vehicle door latch of the above described embodiment, as, for instance, disclosed in DE 100 38 151 C2, the locking lever can be directly coupled with the operating lever, at least for taking up its locking position. This is carried out as part of a first stroke of the operating lever. As part of a second stroke, the respective vehicle door latch or its locking mechanism can now be opened. Such a two-stroke operation has proven to be successful and also in connection with an optical child lock and/or double lock system. It is, however, at this point required to first of all move the double lock and/or child lock into their "off" position, in order to unlock the locking mechanism. That is costly.

Also, a two-part operating lever, as disclosed in patent application DE 101 64 484 is known, which must only be taken into consideration in accordance with §3 (2) PatG. This does, however, not provide a solution for the above problem.

This means that for such vehicle door latches with two-stroke movement of the operating lever for unlocking and opening the locking mechanism, it is still necessary to first move a double lock system and/or child lock system into the "off" position, so that the positions "unlocked" and then "opened" of the locking mechanism can then be assumed. In addition, the solution according to DE patent application 101 64 484 is based on a relatively costly design and a considerable number of components.

Prior art also discloses systems with two-stroke and single-stroke operation. In case of a two-stroke operation, an associated locking mechanism or the vehicle door latch is, first of all, unlocked as part of a first stroke and then opened during a second stroke. The single-stroke operation ensures, on the other hand, unlocking and opening during a single stroke. Both methods are realized with different and, in parts, complicated lever mechanisms. This is costly and this is what the invention aims to remedy.

The invention is based on the technical problem of further developing a vehicle door latch of the design described above in such a way that despite of a simple construction, an easy two-stroke operation as well as a single-stroke operation for opening the locking mechanism is possible.

For solving this technical problem, a vehicle door latch of this type is characterized in that the operating lever contains a first partial lever and a second partial lever and that the locking lever controls a coupling element, which optionally connects the two partial levers.

The DE patent application 101 64 484 also contains a two-part operating lever as well as a coupling element optionally connecting the two partial levers. In the teaching of the invention, on the other hand, the locking lever controls, however, the coupling element, whilst the coupling lever or the coupling element of DE 101 64 484 are acted upon by a safety device, which can be a double lock system and/or a child lock system.

The present innovation thus generalizes the use of an operating lever with a first partial lever and a second partial lever, which can be optionally connected with the aid of the coupling element and in such a way that for the control of the coupling element, the in most cases already existing locking lever or a similar locking element can now be used. An additional safety device in form of a child lock system and/or a double lock system is consequently not required. Such a safety device can, of course, be optionally used, as described in further detail below.

It has proven to be advantageous to design one partial lever as an internal release handle lever and the other partial lever as an internal release actuation lever. The internal release handle lever can be connected to an internal door handle, whilst the internal release actuation lever acts upon the locking mechanism or on a release lever provided there in most cases. This means that the operating lever is regularly but not exclusively an internal operating lever.

In order for the locking lever or the locking element to be able to control the coupling element, the locking lever contains a control journal for a catch profile on the coupling element. Depending on the position of the control journals, compared to that of the catch profile, both of the above elements ensure that the coupling element connects the two partial levers of the operating lever or not. In an alternative embodiment, the control journal of the locking lever can also act upon a leg of a leg spring, arranged on the coupling element.

The coupling element is in most cases a coupling lever, rotatably arranged on the partial lever of the internal operating lever. This other partial lever is, in most cases, the internal release actuation lever. At the same time, the coupling element or the coupling lever engages into a recess of a partial lever, which is the internal release handle lever. The coupling element itself contains a seat for this one partial lever or the internal release handle lever.

The operating lever rotates during a first stroke—with the locking lever in locking position—in such a way that it, e.g. the locking lever, engages the coupling element with the two partial levers. In general, the locking lever can naturally also ensure independently of the operating lever that the coupling element engages, as required, with the partial levers, by the locking lever being respectively motor-driven.

The invention does, however, not make use of this, as instead, the operating lever itself provides the required coupling of the two partial levers during its first stroke whilst the locking lever is in locking position. As in this position, the two partial levers have no more mechanical connection (locking lever in "locked" position) and in which after completion of the first stroke of the operating lever, the mechanical coupling is ensured by the engaging coupling element.

During a second stroke of the operating lever, the locking mechanism is opened. As the mechanical coupling of the internal release handle lever and internal release actuation lever after the first stroke of the operating lever ensures that, for instance, the pulling movement on the internal door handle is transferred onto the locking mechanism via the internal release handle lever, the internal release actuation lever and, in the end, the actuation lever itself.

As according to the invention, the locking lever has a control journal for the profile or the leg spring on the coupling element, a single-stroke operation of the operating lever can also be used instead of the described two-stroke operation. In this case, the control journal is not arranged on the locking lever, so that the coupling element, during initial actuation of the operating lever, directly couples the internal release handle lever to the internal release actuation lever. As a result of this mechanical connection of the two said partial levers to each other, produced initially as part of the stroke, the locking mechanism can be directly opened in the further course of this one stroke.

Such a single-stroke operation is, for instance, recommended when in a vehicle, the vehicle door latches are automatically locked during driving. In this case, an occupant may wish to unlock and simultaneously open the vehicle door latch with only a single stroke. There are also other possible situations, where vehicle door latches are locked manually or by pushing down a button on the inside, whilst driving or stationary. To distinguish this condition from no locking being carried out, a two-stroke operation would be used in the first instance, whilst in case of unlocked vehicle door latches of course only a single stroke operation of the locking mechanisms is required. The teaching of the invention offers, in any case, the option of being able to open the locking mechanism or the vehicle door latch either with a single-stroke or a two-stroke operation, depending on customer preference or requirements. In order to be able to distinguish between these two methods, it is only required to equip the locking lever with a control journal or not.

In addition, the coupling element can be acted upon by the child lock system and/or double lock system. This means that the position "child lock on" or "double lock on" corresponds with the coupling element being in a moved-out position and consequently the partial levers of the operating lever not being connected to each other. At the same time, the coupling element only connects the two partial levers of the operating lever, if both the child lock and the double lock are in their "off" position. This also includes the movement of the locking lever into the "unlocked" position.

As a result, a vehicle door latch is advantageously providing not only with a particularly simply functioning and compact design in case of a two-stroke operation of the operating lever but can also be redesigned in the sense of a single-stroke override. This is simply achieved by the control journal being left out on the locking lever, so that the coupling element directly engages during a first stroke, in order to directly mechanically connect the partial levers. As an option, the described vehicle door latch can be combined with a double lock and child lock function. These constitute the main advantages of the invention.

Figure 2:
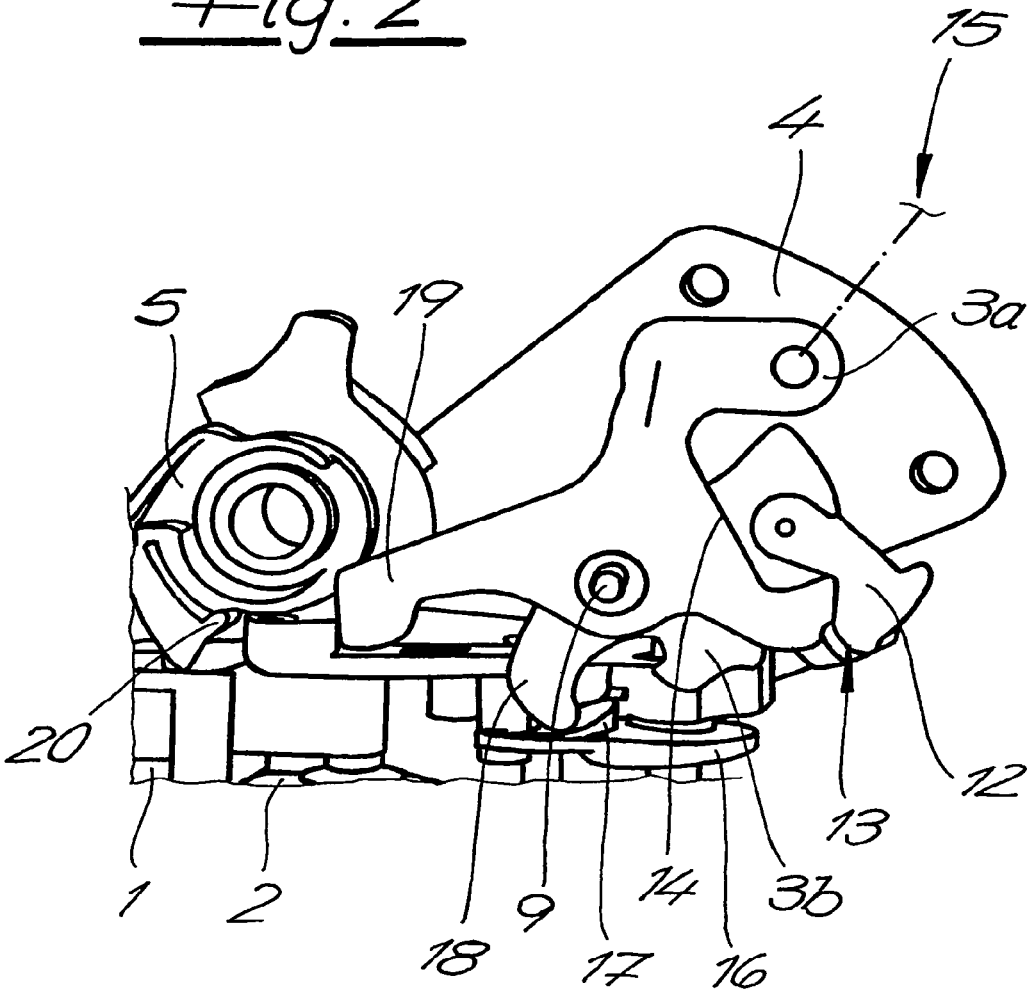
Figure 3:
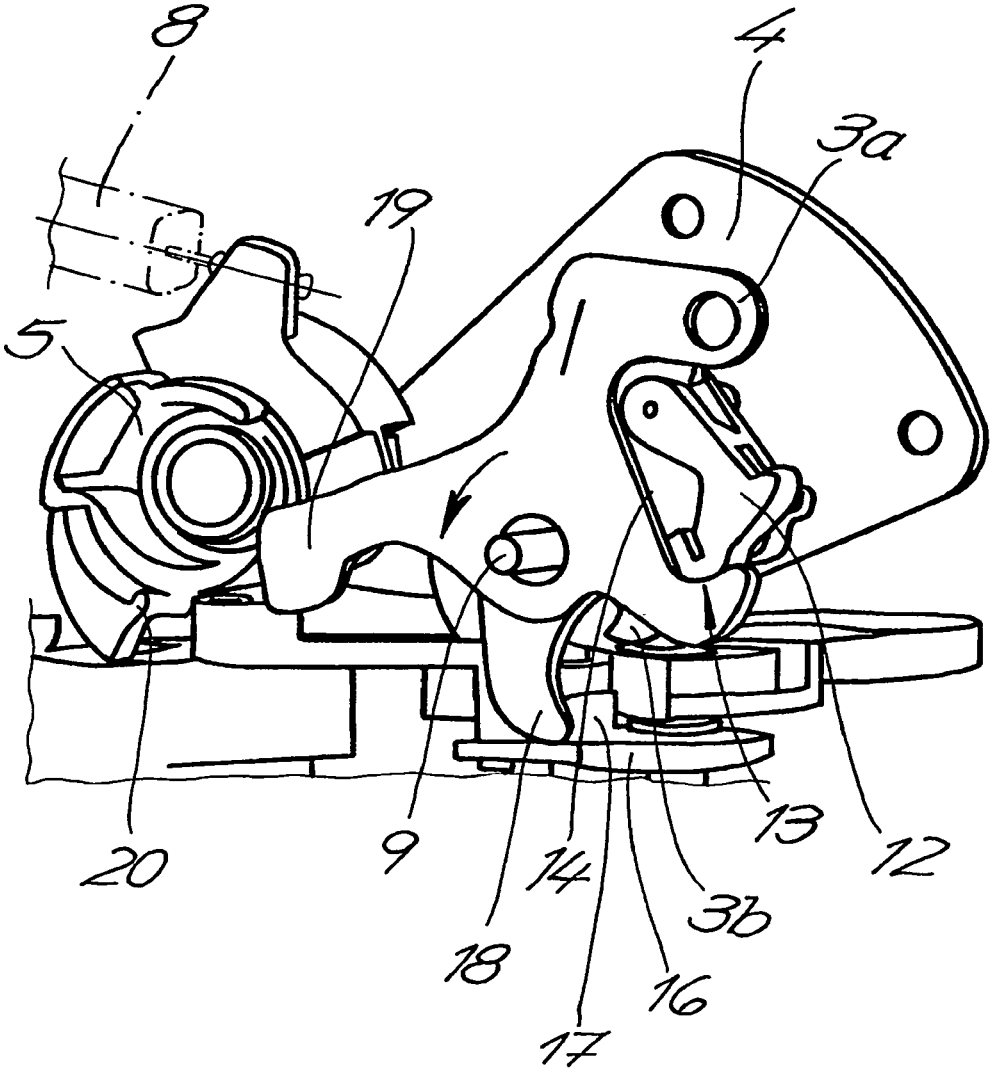

Below, the invention is explained in more detail with reference to drawings showing two embodiments, in which:

FIGS. 1 to 3 show different functional positions of the vehicle door latch, in which the control journal of the locking lever acts upon the profile of the coupling element FIGS. 4 to 5 shows different functional positions of the described vehicle door latch, in which the control journal of the locking lever acts upon a leg spring arranged on the coupling element The standard design of the vehicle door latch comprises a locking mechanism 1, 2 consisting of a catch 1 and a pawl 2, an operating lever 3*a*, 3*b* and two locking levers 4, 5. The two locking levers 4, 5 are coupled to each other by means of a journal 6 of the locking lever 5, engaging into a slot 7 of the internal locking lever or of the catch lever 4. In general, also only one locking lever 4, 5 is possible.

In any way, a motor or electric motor 8, only indicated in FIG. 3, is able to pivot the locking lever 5 clockwise during the transition from FIG. 1 to FIG. 2 as indicated, so the internal locking lever 4 or the catch lever carries out an anti-clockwise rotation around its axis 9, as a result of the journal 6 engaging in the recess or slot 7. This axis 9 accommodates at the same time, the partial levers 3*a*, 3*b* making up the operating lever 3*a*, 3*b*, which in the case of the embodiment, is an internal operating lever 3*a*, 3*b*. One partial lever 3*a* is designed as an internal release handle lever 3*a*, whilst the other partial lever 3*b* is an internal release actuation lever 3*b*.

The described motorized movement of the locking lever 5 and thus of the internal locking lever 4 results in that a journal 10 located on the internal locking lever 4 either interacts with a profile 11 on a coupling element 12 or with a leg of a leg spring 22 arranged on the coupling element 12. The coupling element 12, designed as a coupling lever 12, is able to either mechanically connect the partial lever 3*a*, 3*b* with each other or not. For this purpose, the coupling element or the coupling lever 12 is rotatably arranged on the partial lever 3*b* or on the internal release actuation lever 3*b* and contains a seat 13 for the one partial lever 3*a* or the internal release handle lever 3*a*. The coupling element 12 in its entirety is arranged in one recess 14 of the one partial lever 3*a* or the internal release handle lever 3*a*.

Where now, according to a first embodiment shown in FIGS. 1 and 2, the internal locking lever 4 carries out the anti-clockwise movement around axis 9 during the transition from FIG. 1 to FIG. 2, journal 10 of the internal locking lever 4, gliding along the profile or the catch profile 11, ensures that the coupling element 12 is pivoted by a moving-out area 11*a* of the profile. As in the described anti-clockwise movement of the internal locking lever 4, the journal 10 moves at the same time "upwards" in FIGS. 1 and 2.

According to a second embodiment shown in FIGS. 4 and 5, a leg spring 22 is arranged on the coupling lever 12 and in particular, a pivot 21, coinciding with the rotational axis of a coupling lever 12 arranged on the internal operating lever 3*b*, said leg spring corresponding with the control journal 10 of the locking lever 4.

Where the locking lever 4 and thus also the control journal 10 carries out an anti-clockwise pivoting movement according to FIGS. 1 and 2, the control journal 10 according to FIG. 5 moves the leg 23 of the leg spring 22 with the result that the coupling lever 12 is moved out of its swung-out position by the leg spring 22.

In detail, the control journal 10 of the locking lever 4 is arrange in an area between the two legs 23, 24 of the leg spring 22, with the control journal 10 in case of the position of the locking lever 4 shown in FIG. 1 or FIG. 4 contacting the leg 24 and, in case of the position of the locking lever 4 shown in FIG. 2 or FIG. 5, contacts the leg 23 of the leg spring 22.

The pivoted-out coupling lever or the coupling element 12 allows that upon completion of a first activation stroke, the two partial levers 3*a*, 3*b* are mechanically connected by means of the coupling element 12. This is shown in FIG. 2 or in FIG. 5. In this case, the locking lever 4, 5 or the internal locking lever 4 has provided the control for the coupling element 12, i.e. the interaction of its journal 10 with either profiles 11 or the leg spring 22 on the coupling element 12.

The first stroke of the operating lever 3*a*, 3*b* or of the internal release handle lever 3*a* is generated by a pulling movement on an internal door handle 15, connected to the respective internal release handle lever 3*a* via any connection element. As soon as mechanical coupling of the two partial levers 3*a*, 3*b* has been achieved by the first stroke of the operating lever 3*a*, 3*b* or its internal release handle lever 3*a*, the internal release actuation lever 3*b* can act upon a release lever 16, equipped with an edge 17, against which a projection 18 of the internal release actuation levers 3*b* is positioned.

During this process, the internal release handle lever 3*a* is moved back into the position shown in FIG. 1 by a spring after the pulling movement corresponding with the first stroke. The seat 13 of the coupling element 12 also overlaps the internal release actuation lever 3*b*, so that the coupling element 12 is positioned in the recess 14 with connection of the partial levers 3*a*, 3*b* (see FIG. 3).

After coupling of the two partial levers 3*a*, 3*b*, projection 18 can, as part of the second stroke of the operating lever 3*a*, 3*b*, act upon the release lever 16 in such a way that the locking mechanism 1, 2 is opened.

The described motor-driven anti-clockwise rotation of the internal locking lever 4 around its axis 9 corresponds, for instance, to a central locking function. As in the "locked" position shown in FIG. 1 pulling movements on the internal door handle 15 cause the operating lever 3*a*, 3*b* with an extension arm 19 to be placed against the stop 20 of the locking lever 5 moving it, e.g. the locking lever 5 into its "unlocked" position. —Naturally, the internal locking lever 4 can, apart from by means of a motor, also be manually pivoted-out, which, however, is not shown.

In the described method of the extension arm 19 being placed against stop 20 of the locking lever 5, the journal 10 on the internal locking lever 4 automatically carries out the already described swinging-out of the coupling element 12. Upon completion of the first stroke of the operating lever 3*a*, 3*b* both partial levers 3*a*, 3*b* are coupled as a result of this action. At the same time, an optional child lock or double lock is unlocked In any case, the second stroke of the operating lever 3*a*, 3*b* ensures that the now continuous mechanical connection from the internal door handle 15 to the release lever 16, allows opening of the locking mechanisms 1, 2 as a result of a pulling movement on the internal door handle 15.

This is, in particular, apparent from FIG. 3. As, after completion of the first stroke of the operating lever 3*a*, 3*b* the internal release handle lever 3*a* is returned into the position shown in FIG. 1 by a spring, so that the coupling element 12 assumes the position shown in FIG. 3. The two partial levers 3*a*, 3*b* are coupled, so that a repeated pulling movement on the internal door handle 15 causes an anti-clockwise movement of the operating lever 3*a*, 3*b* around its axis 9 and consequently, the locking mechanism 1, 2 is opened.

The described vehicle door latch also allows a single-stroke actuation of the locking mechanisms 1, 2. For this purpose, this one stroke not only ensures the unlocking of the vehicle door latch but also, at the same time, its opening. In this case, the control journal 10 is not installed on the locking lever or internal locking lever 5. As a result, the coupling element 12 directly engages into the recess 14, when the internal release handle lever 3*a* is acted upon. At the same time, the extension arm 19 ensures that the internal locking lever 4 takes up its "unblocked" position. As a result of the mechanical coupling of both partial levers 3*a*, 3*b*, the locking mechanism 1, 2 can be directly opened during the course of this stroke of the internal release handle lever 3*a*. The vehicle door latch does thus, in this case, not assume the interim position as shown in FIG. 2 during the transition from FIG. 1 to FIG. 3.

The invention claimed is:

1. A vehicle door latch with a locking mechanism comprising at least one operating lever having a first partial lever and a second partial lever, said first partial lever and said second partial lever having a common first axis of rotation;

a coupling element having a second axis of rotation and being formed to mechanically connect or disconnect said first partial lever with said second partial lever; and a locking lever having said first axis of rotation and controlling a movement of said coupling element around said second axis of rotation;

wherein said coupling element is pivotably disposed on said second partial lever.

2. The vehicle door latch of claim 1, wherein said first partial lever is connected to an internal door handle, and said second partial lever is movable against a release lever to open said locking mechanism.

3. The vehicle door latch of claim 1, wherein said coupling element comprises further a profile and said locking lever comprises further a control journal, said control journal being engageable with said profile.

4. The vehicle door latch of claim 1, wherein said coupling element comprises further a leg spring having a leg, and said locking lever comprises further a control journal, said control journal being engageable with said leg.

5. The vehicle door latch of claim 4, wherein said coupling element is engagable by a child lock system and/or an anti-theft system, said child lock system or said anti-theft system being unlocked upon completion of step one.

6. The vehicle door latch of claim 1, wherein said coupling element is engagable by a child lock system and/or an anti-theft system.

7. The vehicle door latch of claim 1, wherein said locking lever is pivoted by a motor or directly manually.

8. A vehicle door latch with a locking mechanism comprising at least one operating lever having a first partial lever and a second partial lever, said first partial lever and said second partial lever having a common first axis of rotation;

a coupling element having a second axis of rotation and being formed to mechanically connect or disconnect said first partial lever with said second partial lever; and a locking lever having said first axis of rotation and controlling a movement of said coupling element around said second axis of rotation;

wherein said first partial lever comprises further a recess, said coupling element being engageable with said recess.

9. The vehicle door latch of claim 8, wherein said first partial lever comprises further an extension arm, and the locking mechanism is opened in a one-step process comprising said coupling element directly engaging into said recess when said first partial lever is acted upon, and simultaneous unblocking of said locking lever by said extension arm.

10. A vehicle door latch with a locking mechanism comprising at least one operating lever having a first partial lever and a second partial lever, said first partial lever and said second partial lever having a common first axis of rotation;

a coupling element having a second axis of rotation and being formed to mechanically connect or disconnect said first partial lever with said second partial lever; and a locking lever having said first axis of rotation and controlling a movement of said coupling element around said second axis of rotation;

wherein said coupling element comprises further a seat, said first partial lever being engageable with said seat.

11. A vehicle door latch with a locking mechanism comprising at least one operating lever having a first partial lever and a second partial lever, said first partial lever and said second partial lever having a common first axis of rotation;

a coupling element having a second axis of rotation and being formed to mechanically connect or disconnect said first partial lever with said second partial lever; and a locking lever having said first axis of rotation and controlling a movement of said coupling element around said second axis of rotation;

wherein said locking mechanism is configured to be opened in a two-step process; step one comprising pivoting of said locking lever by said first partial lever when said locking lever is in a locking position so that said coupling element mechanically connects said first partial lever with said second partial lever; and step two comprising said first partial lever connected with said second partial lever engaging said locking mechanism.

* * * * *